US005901591A

United States Patent [19]

Kaplan

[11] Patent Number: 5,901,591

[45] **Date of Patent: * May 11, 1999**

[54] PINCH ROLL SHAPEMETERING APPARATUS

[75] Inventor: Naum M. Kaplan, Monroeville, Pa.

[73] Assignee: Tippins Incorporated, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/639,724

[22] Filed: Apr. 29, 1996

[51] Int. Cl.[6] ..... B21B 37/28

[52] U.S. Cl. ..... 72/9.1; 72/11.7; 72/229

[58] Field of Search ..... 72/9.1, 10.4, 10.5, 72/11.2, 14.4, 6.1, 6.2, 19.2, 7.6, 10.7, 11.7, 8.4, 8.9, 11.1, 11.6, 12.7, 229; 326/45, 183

[56] References Cited

U.S. PATENT DOCUMENTS

| | | | |
|---|---|---|---|
| 2,655,823 | 10/1953 | Cozzo | 72/6.1 |
| 3,194,036 | 7/1965 | Canfor et al. | 72/11 |
| 3,331,232 | 7/1967 | King | 72/365 |
| 3,459,019 | 8/1969 | Stone | 72/12 |
| 3,688,571 | 9/1972 | Atkins et al. | 73/144 |
| 3,714,806 | 2/1973 | Berkey et al. | 72/10.4 |
| 4,289,005 | 9/1981 | Cabaret et al. | 72/12 |
| 4,356,714 | 11/1982 | Quehen | 72/17 |
| 4,428,244 | 1/1984 | Takeda | 73/862.07 |
| 4,512,170 | 4/1985 | Hsu | 72/17 |
| 4,700,557 | 10/1987 | De Mol et al. | 72/12 |
| 4,805,492 | 2/1989 | Tsuruda | 72/9.1 |
| 4,809,527 | 3/1989 | Mitchell | 72/8 |
| 4,809,528 | 3/1989 | Lawson et al. | 72/11.7 |
| 4,860,212 | 8/1989 | Uesugi | 364/472 |
| 4,964,289 | 10/1990 | Dean | 72/13 |
| 4,972,706 | 11/1990 | Adolfsson et al. | 72/11.7 |
| 5,089,776 | 2/1992 | Furukawa et al. | 324/227 |
| 5,231,858 | 8/1993 | Yamashita et al. | 72/12 |
| 5,267,170 | 11/1993 | Anbe | 364/472 |
| 5,285,684 | 2/1994 | Uesugi et al. | 73/159 |
| 5,379,631 | 1/1995 | Kira et al. | 72/11.1 |
| 5,400,258 | 3/1995 | He | 364/471 |
| 5,540,074 | 7/1996 | Smith et al. | 72/229 |
| 5,546,779 | 8/1996 | Ginzburg | 72/11.7 |

FOREIGN PATENT DOCUMENTS

| | | | |
|---|---|---|---|
| 4-262812 | 9/1992 | Japan | 72/11.6 |
| 4-279208 | 10/1992 | Japan | 72/11.6 |
| 6-71316 | 3/1994 | Japan | 72/8.9 |

OTHER PUBLICATIONS

"Stressometer flatness transducer for cold strip mills"; Michael Henze et al.; ASEA Pamphlet AV 86–104 E; Edition 1; 3 pp.; Sep. 1970.

"Practical Shape Meter for Hot Strip Mill"; *New Technology*; p. 89; 1985.

"New developments improve hot strip shape: Shapemeter–Looper and Shape Actimeter"; George F. Kelk et al.; *Iron and Steel Engineer*; pp. 48, 49 and 51–56; Aug. 1986.

"A new solution to flatness measurement"; Scandinavian Steel; Pekka Kantola et al.; *Steel Times*; 2 pp.; Aug. 1995.

"*Long Time Experience with the Hoesch Flatness Measuring and Control System for Rolling Hot Strips*"; W. Fabian et al.; pp. A.27.1–A.27.5; [date unknown].

"37 Further Developments in Flatness Control on Hot Mills"; *Session 7A—Hot Strip—Measurement and Control*; pp. 334, 340 and 341; [date unknown].

"The Tensometer, a segmented looper measuring system for differential tension in a hot strip mill"; Hermann J. Kopineck et al.; 14 pp.; [date unknown.].

"Flatness Sensors"; Chapter 6; pp. 45–46; [date unknown.].

*Definition of Flat Rolled Product Geometry, Part 1*; pp. 14–20; [date unknown.].

*Primary Examiner*—Joseph J. Hail, III
*Assistant Examiner*—Ed Tolan
*Attorney, Agent, or Firm*—Webb Ziesenheim Bruening Logsdon Orkin & Hanson, P.C.

[57] ABSTRACT

A shape detection device incorporated as part of a pinch roll assembly in a hot strip reversing mill. The shape detection device replaces one of the rolls in the pinch roll assembly. The shape detection device is used to provide data to an automated shape control and steering system.

20 Claims, 1 Drawing Sheet

PINCH ROLL SHAPEMETERING APPARATUS

BACKGROUND

1. Field of Invention

The present invention relates to shape detection methods and apparatuses for a hot strip mill, and more particularly, to a shape detection device and method used in conjunction with a pinch roll assembly and a hot strip reversing mill or mills.

2. Background Art

During the hot rolling of metal strip, such as steel, the rolling process can cause undesirable shape defects in the profile and flatness along the width of the metal strip. This generally results from internal stress differentials within the strip which appear during reduction in a hot strip reversing mill having coiler furnaces on opposite sides. As the need for improved shape is ever present from a mill, techniques are required to ensure the desired shape is achieved during the reduction of the metal strip.

These shape defects can be greatly minimized and often avoided by applying shape control techniques in controlling the rolls of the mill. Shape control techniques include adjustments at the reversing stand of roll bending, screw down positions and roll shifting. Also, it is important to control the steering of the metal strip between the rolls at the reversing stand to keep the metal strip tracking on mill center.

In order to apply the shape control techniques, the operator must be able to detect when the process is causing the shape defects or when the metal strip tracks off mill center. Currently, the operator visually checks for defects caused by the process and to ensure that the metal strip is tracking on mill center. The operator then must adjust the mill manually using the shape control techniques to correct for defects and adjust steering of the metal strip if the metal strip is off mill center.

Pressure transducers and load cells have been used on each side of the reversing stands to detect force differentials between the stand sides to indicate the metal strip is tracking off mill center. The use of pressure transducers or load cells can be unreliable because strip geometry, temperature changes in the metal or hardness of the metal can also cause force differentials that can be detected by the pressure transducers or the load cells.

Today, automated shape control systems using computer technology can control shape and steering of the metal strip with the use of shape control sensors. Shape control sensors detect metal strip position and shape defects throughout the metal strip. The shape control system uses the data from the sensor for monitoring and continuously correcting the flatness of the metal strip. The automated shape control system relieves the operator from visually checking for defects and manually making changes to the process. Such systems and shape control sensors are described in U.S. Pat. Nos. 3,459,019; 3,688,571; 4,289,005; 4,356,714; 4,428,244; 4,512,170; 4,700,557; 4,809,527; 4,809,528; 4,860,212; 4,964,289; 5,089,776; 5,231,858; 5,267,170; 5,285,684; and 5,400,258.

The problem that arises is that shape control sensors must be incorporated into the design of a mill. Shape control sensors can be a contact or non-contact shapemetering device as discussed in the above-mentioned patents. Each type of shapemetering device has the sole purpose of detecting shape defects in the metal strip and has been used in cold strip mills. Currently for Steckel and other hot strip reversing mills, an operator still checks for shape defects visually and makes manual adjustments to the mill. Visual detection by an operator is still employed because the mills already in operation are generally restricted to the space available to add a contact or non-contact shapemetering device. Non-contact shapemetering devices are not used because their size does not allow them to be located near the rolls of the reversing stand where the reduction process takes place. Contact shapemetering devices are not used because it could prove to be a complicated and costly process to add a device to current mill designs that can make contact with the metal strip under tension.

Therefore, it is an object of the present invention to integrate a sensor for shape control and steering of the metal strip into existing hot strip reversing mills with minimal modification to the mill design as well as provide new mills with the same advantage.

SUMMARY OF THE INVENTION

The present invention defines a shape detection device incorporated as part of a pinch roll assembly in a hot strip reversing mill. The shape detection device supplies data to a shape control and steering system. The shape detection device replaces one of the rolls in a pinch roll assembly and includes at least one sensor. Examples of the sensor used are a load cell or a strain gauge. The shape detection device can be a segmented roll made up of a plurality of segments where each segment includes at least one sensor. The invention also defines a method of retrofitting a hot strip reversing mill with a pinch roll assembly that includes a shape detector.

DESCRIPTION OF THE PREFERRED EMBODIMENTS

Figure 1:
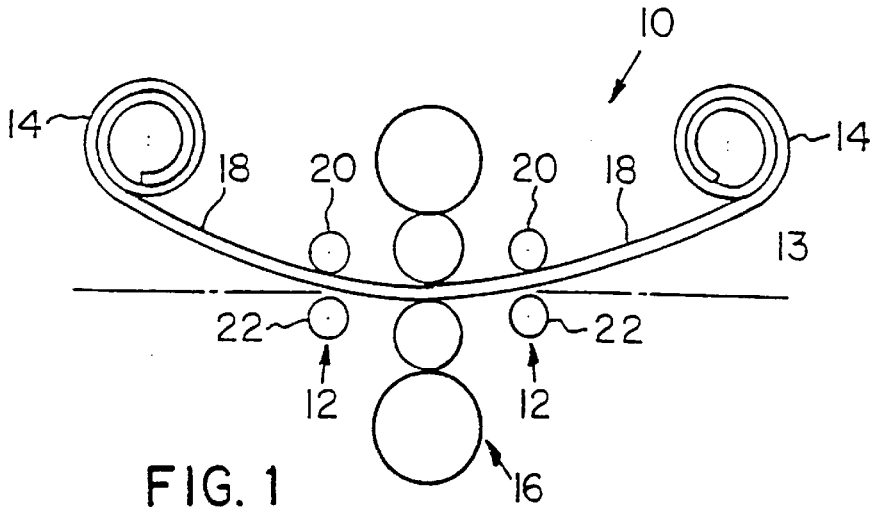
FIG. 1 illustrates a typical hot strip reversing mill of the Steckel mill variety.

FIG. 1 shows a typical Steckel hot strip reversing mill 10. Mill 10 includes a hot reversing stand 16 having coilers 14 generally in the form of coiler furnaces (not shown) for receiving a metal strip 18 when it has been reduced or when it is at a thickness capable of being coiled. A pinch roll assembly 12 is located between the hot reversing stand 16 and each coiler 14 to assist in feeding the strip 18 and to assist in tensioning and/or tracking as the case may be. It is also known to use more than one hot reversing stand intermediate to the coiler furnaces and the illustration of a single stand 16 is exemplary only. Current Steckel mills generally do not have a location to accommodate an additional device for shapemetering. The present invention provides a shape sensor roll of the contact device variety that can be retrofitted to current hot strip reversing mills for shapemetering.

Figure 2:
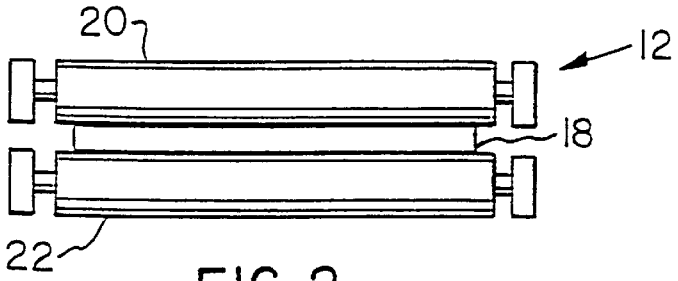
FIG. 2 illustrates a typical pinch roll assembly.

One of the pinch roll assemblies 12 in FIGS. 1–2 is used to move a metal strip 18 from one of the coilers 14 to the reversing stand 16 and provide a tension force on the metal strip 18 between the coiler 14 and the reversing stand 16.

Each pinch roll assembly 12 includes a top roll 20 and a bottom roll 22 which are generally hydraulically operated with both in contact with the metal strip 18 for the strip's guidance to the reversing stand 16. The bottom roll 22 is typically driven and moves the metal strip 18 via frictional forces toward the stand 16 for engagement. The stand 16 then feeds the metal strip through the second pinch roll assembly which is open for the strip's engagement with the other coiler 14. This engagement of the other coiler 14 is usually accomplished by feeding the strip to a gate at the entry end of a coiler furnace, in which the gate is actuated to feed the strip 18 into a slot on a mandrel which acts as the coiler 14. These systems are well recognized in the art and are not shown in detail. While the metal strip 18 is moving toward the stand 16, both rolls 20, 22 provide a pressure force on the metal strip 18. Once the metal strip 18 engages the stand 16, the pressure force of the pinch roll assembly 12 is released, but the top roll 20 continues to contact the metal strip 18. The top roll 20 of both pinch roll assemblies 12 is virtually always in contact with the strip 18 during the reduction process because the coiler furnaces are generally positioned above the horizontal pass line 13 causing coiler 14 to sit at a slight angle above the roll bite of the reversing stand 16. The top roll 20 of the pinch roll assembly 12 is generally located at a less acute angle above the roll bite of the reversing stand 16 than the coiler 14.

Figure 3:
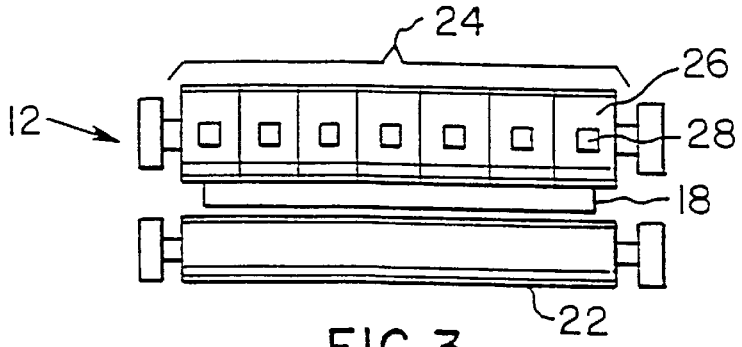
FIG. 3 is a pinch roll assembly according to the present invention.
Figure 4:
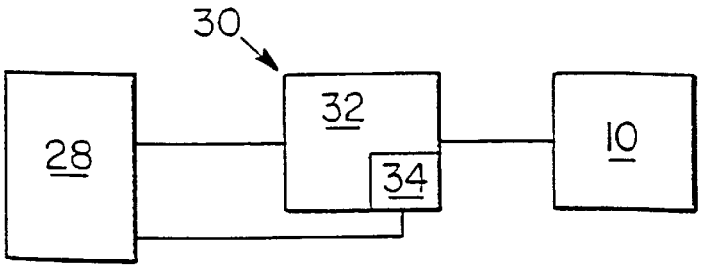
FIG. 4 is a schematic view of an automated shape control system which includes a pinch roll assembly having a shape sensor roll.

The present invention is a shape sensor roll that includes a shape detector to replace the top roll 20 of the pinch roll assembly 12. The sensor roll in the preferred embodiment is a segmented roll 24 shown in FIG. 3 which functions as a top roll in a pinch roll assembly and as a shapemetering roll. The segmented roll 24 is made up of a plurality of segments 26. Each segment 26 includes a sensor 28 such as a load cell or strain gauge to detect strain forces and the location of the metal strip 18 in relation to the mill center. The sensors 28 provide data to a shape control system 32 of an automated control system 30 as shown in FIG. 4 which monitors and continuously corrects the profile and flatness of the metal strip 18. A steering control system 34 can also be included as part of the automated control system 30 to continuously monitor the tracking of the metal strip 18 on mill center and correct the steering of the metal strip to ensure the metal strip 18 tracks on mill center.

In effect, the individual sensors 28 detect strain forces and collectively the sensors 28 identify any differential stress which will manifest as a shape defect. The automated control system 30 automatically adjusts any one or more of roll bending, screw down positions, roll shifting, steering of the metal strip as well as other control functions of the mill in order to correct for defects that occur during the rolling of the metal strip 18. In this way an automated control system 30 with a sensor roll acting as part of a pinch roll assembly 12 can be retrofitted to an existing hot strip reversing mill 10 to provide automated control over the shape and steering of the metal strip 18.

The shape sensor roll can be used in just one or both of the pinch roll assemblies 12. To retrofit an existing mill facility, it is only necessary to replace the top roll 20 of the either or both pinch roll assemblies 12 with a shape sensor roll and tie the signals from the shape detector of the shape sensor roll into a shape control system loop used in the particular mill which has been retrofitted. It is noted that if the coilers 14 are positioned below the pass line 13 (not shown), then the bottom roll 22 of the pinch roll assembly 12 would be the roll which is replaced by a shape sensor roll.

Various modifications and applications of the invention described and shown will suggest themselves to those acquainted with the art, and accordingly are considered to be within the spirit and scope of the invention.

I claim:

1. A hot strip reversing mill having at least one hot reversing stand adapted for hot rolling of metal strip, at least one coiler on either side of the hot reversing stand and a pinch roll assembly including a pair of rolls positioned between said coiler and the hot reversing stand, wherein said pair of rolls are adapted to engage the metal strip and the path of the metal strip is selectively deflected by said engagement with at least one of said pair of rolls, the improvement comprising:

one of said rolls in said pinch roll assembly including a shape detector to form a shape metering roll detecting defects in the shape of the metal strip, wherein said shape metering roll detects characteristics of the metal strip at a plurality of locations across the width of the metal strip.

2. A hot strip reversing mill as claimed in claim 1, said improvement further including a shape control system to receive data from said shape detector in order to correct for the defects in the metal strip using shape control techniques.

3. A hot strip reversing mill as claimed in claim 1, further including a steering control to receive data from said shape detector in order to ensure the metal strip tracks on mill center.

4. A hot strip reversing mill as claimed in claim 1, wherein said roll including a shape detector is a segmented roll comprising a plurality of segments, each segment having at least one sensor.

5. A hot strip reversing mill as claimed in claim 4, wherein said sensor is a load cell.

6. A hot strip reversing mill as claimed in claim 1, wherein said roll including a shape detector is the roll of the pinch roll assembly that is on the same side of a pass line of the hot strip reversing mill as the coiler.

7. A pinch roll assembly for monitoring and continuously correcting flatness in a metal strip, said assembly comprising:

a top roll and a bottom roll adapted to engage the metal strip, wherein the path of the metal strip is selectively deflected by engagement with at least one of said top roll and said bottom roll;

wherein at least one of said top roll and said bottom roll includes a shape detector for detecting defects in the metal strip, wherein said shape detector detects the characteristics of the metal strip at a plurality of locations across the width of the metal strip, said shape detector being configured to supply data to a shape control system that can correct for defects in the shape of the metal strip.

8. A pinch roll assembly as claimed in claim 7, wherein said roll including a shape detector is a segmented roll comprising a plurality of segments, each segment having at least one sensor.

9. A pinch roll assembly as claimed in claim 8, wherein said sensor is a load cell.

10. A pinch roll assembly as claimed in claim 7, wherein said shape detector includes means to detect metal strip position in relation to mill center.

11. A pinch roll assembly as claimed in claim 7, wherein said roll including a shape detector is a roll of the pinch roll assembly that is on the same side of a pass line of the hot strip reversing mill as the coiler.

12. A method of retrofitting a shape detector to a hot strip reversing mill having at least one hot reversing stand adapted for hot rolling of metal strip, at least one coiler on either side of the hot reversing stand and a pinch roll assembly including a pair of rolls positioned between said coiler and the hot reversing stand, wherein said pair of rolls are adapted to engage the metal strip and the path of the metal strip is selectively deflected by said engagement with at least one of said pair of rolls, comprising the steps of:

a) removing one of said rolls in said pinch roll assembly; and b) replacing said roll removed in step a) with a roll including a shape detector for detecting defects in the shape of a metal strip wherein said shape detector detects the characteristics of the metal strip at a plurality of locations cross the width of the metal strip.

13. A method as claimed in claim 12, further including the steps of:

adding a shape control system to the hot strip reversing mill; and connecting said shape detector to said shape control.

14. A method as claimed in claim 12, further including the steps of:

adding a steering control to the hot strip reversing mill; and connecting said shape detector to said steering control.

15. A method as claimed in claim 12, wherein said roll including a shape detector is a segmented roll comprising a plurality of segments, each segment having at least one sensor.

16. A method as claimed in claim 15, wherein said sensor is a load cell.

17. A method as claimed in claim 12, wherein said roll including a shape detector is the roll of the pinch roll assembly that is on the same side of a pass line of the hot strip reversing mill as the coiler.

18. A hot strip reversing mill comprising:

at least one hot reversing stand adapted for hot rolling of metal strip;

at least one coiler on either side of said at least one hot reversing stand; and at least one shapemetering roll for detecting defects in the metal strip, wherein said shapemetering roll detects characteristics of the metal strip at a plurality of locations across the width of the metal strip and said shape metering roll forms a deflection roll deflecting the path of said strip.

19. The hot strip mill of claim 18 wherein said shapemetering roll is one roll of a pinch roll assembly.

20. The hot strip mill of claim 19 wherein said shapemetering roll of said pinch roll assembly is acting as a deflector roll during shape measurements.

* * * * *

UNITED STATES PATENT AND TRADEMARK OFFICE

CERTIFICATE OF CORRECTION

PATENT NO. : 5,901,591

DATED : May 11, 1999

INVENTOR(S) : Naum M. Kaplan

It is certified that error appears in the above-identified patent and that said Letters Patent is hereby corrected as shown below:

Claim 1 Column 4 Line 16 "shape metering" should read --shapemetering--.

Claim 7 Column 4 Line 37 after "A" insert --hot strip reversing mill having a--.

Claim 7 Column 4 Line 43 after "roll;" insert --and--.

Claim 12 Column 5 Line 13 "locations cross" should read --locations across--.

Claim 18 Column 6 Lines 17-18 "shape metering" should read --shapemetering--.

Signed and Sealed this

Fourteenth Day of December, 1999

*Attest:*

Q. TODD DICKINSON

*Attesting Officer*

*Acting Commissioner of Patents and Trademarks*